United States Patent [19]

El Mouchi

[11] 4,218,108

[45] Aug. 19, 1980

[54] TRACK LIGHTING APPARATUS

[76] Inventor: Daniel El Mouchi, 152 Avenue Floréal, Brussels, Belgium

[21] Appl. No.: 698,571

[22] Filed: Jun. 22, 1976

[30] Foreign Application Priority Data

Jun. 25, 1975 [BE] Belgium ..... 830637

[51] Int. Cl.[3] ..... H01R 13/54

[52] U.S. Cl. ..... 339/82; 339/22 B; 339/39; 339/75 M

[58] Field of Search ..... 339/22 R, 22 B, 39, 339/75 M, 82

[56] References Cited

U.S. PATENT DOCUMENTS

| | | | |
|---|---|---|---|
| 3,273,103 | 9/1966 | Ericson | 339/22 B |
| 3,973,818 | 8/1976 | Soquenne | 339/22 B |

FOREIGN PATENT DOCUMENTS

| | | | |
|---|---|---|---|
| 2216145 | 10/1973 | Fed. Rep. of Germany | 339/22 R |

*Primary Examiner*—Roy Lake
*Assistant Examiner*—Eugene F. Desmond
*Attorney, Agent, or Firm*—Krass & Young

[57] ABSTRACT

An electrical connecting device is provided. The device comprises a supporting channel having, on one of its lateral faces, a longitudinal slot. The slot permits slidable insertion of at least one electrical connecting component having a selector switch, an electrical receptacle for electrical connection and an adapter which can be inserted inside the supporting channel slot. The adapter is equipped with conductive terminals adapted to enter into contact with conductors located on one or both of the two inside lateral faces of the supporting channel, adjacent to the one which has the lengthwise slot. The adapter is located inside the connecting component in such a way as to be able to pivot on its longitudinal axis to the left or the right from its inserting position when the connecting component is introduced into the supporting channel. The connecting component is immobilized in relation to the supporting channel when the adapter is rotated to either one of its extreme positions relative to its position to insertion into the supporting channel. Each conductive terminal of the adapter is in contact with one conductor in at least one of the extreme positions of the adapter.

7 Claims, 3 Drawing Figures

TRACK LIGHTING APPARATUS

This present invention relates to an electrical connecting device having a supporting channel "called track", which one of its lateral face has a longitudinal slot allowing insertion of at least one or more of the electrical connecting device. This device being capable of being inserted inside of the supporting track is equipped with a selector switch—one electrical receptacle for electrical connection and one adapter which can be inserted inside the supporting track; said adapter is equipped with conductive terminals destined to enter into contact with the conductors located on one or on the two inside lateral faces of the supporting track adjacent to the one which has the above mentioned lengthwise slot.

In expressing "electrical connecting device" one must understand of this present invention a device incorporating amongst other things, one adapter, one selector switch, one electrical receptacle, this device being able to be introduced inside of the supporting track and destined to connect said electrical connecting device with the conductors located inside the supporting track.

By the term "adapter" it must be understood in this present invention, a device equipped with conductive terminals which can be positioned when the electrical connecting device is inserted inside the supporting track.

It is common knowledge that electrical connecting devices incorporating a supporting track and a connecting component equipped with an adapter exist. Following the same kind of principle, when the electrical connecting device is engaged inside the longitudinal slot provided in one lateral face of the supporting track, it is possible to pivot the adapter from a determined angle into one direction by means of a cammed lever. The adapter is equipped with three conductive terminals, the longitudinal axis of the adapter and the longitudinal axis of the conductive terminals being situated in the same plane, the median conductive terminal being in this phase, located with regard to the longitudinal axis of the adapter on the opposite side of the two other conductive terminals. After pivoting the adapter, the conductive terminals are in contact with the conductors located on the two lateral faces of the supporting track adjacent to the one which provides the lengthwise slot (two conductors on one face and one conductor on the other). The disadvantage of this device is that the adapter can pivot on its longitudinal axis in one direction and limited angle only, that is only on the side of the position it occupies when the connecting component is introduced inside the supporting track. Since these tracks are often equipped with three conductors on each inside lateral face of the supporting track adjacent to the one that provides the lengthwise opening, it is necessary to retrieve the electrical connecting device from the supporting track and manually rotate it 180° before re-inserting it in the track and pivot once more the cammed lever to enter into contact with the conductors opposite to the conductors mentioned previously.

In other way, following the description of the electrical connecting device, the arrangement of the conductive terminals in the adapter does not allow the electrical connecting device above mentioned to be utilized with a supporting track having conductors located only on one inside lateral face of the track adjacent to the one having the longitudinal slot, which is the case in all the supporting tracks presently manufactured.

As such, it is necessary to seek different types of electrical connecting devices and adapters, which will reduce fabricating cost, since the type mentioned in the above paragraph can only be produced in limited quantity and complicated seriously the distribution of these types.

Consequently, an object of this present invention is to realize a perfected electrical connecting device which shall eliminate the above mentioned inconveniences.

In accordance with the subject invention, the adapter is located inside the connecting component in such way as to be able to pivot within its longitudinal axis to the left or to the right from its inserting position when the connecting component is introduced into the supporting track, the connecting component being immobilized in relation to the supporting track during the rotation of the adapter in either one of its extreme position relative to its position at the time of its insertion into the supporting track, each conductive terminal of the adapter being at least in one of the extreme positions of the adapter and in contact with one conductor located on one lateral face of the track adjacent to the one which offers the longitudinal slot, the conductive terminals being oriented according to the longitudinal direction of the slot and the intermediary position the adapter has when the connecting component is engaged into the supporting track.

In one embodiment of the invention, the conductors are affixed on the inside of the two lateral faces of the track adjacent to the one that offers the longitudinal slot, each conductive terminal being in contact with a conductor affixed on the inside lateral face of the track adjacent to the face having the longitudinal slot when being in each of the extreme positions of the adapter.

In another embodiment of the invention, the longitudinal axis of the adapter and the longitudinal axis of the conductive terminals are situated on the same plane, the conductive terminals being located on the same plane and same side of the longitudinal axis of the adapter.

In the preferred embodiment of the invention, the connecting component incorporates built-in means to make the adapter pivot, they are situated on the portion of the connecting component which remains apparent, when the portion that enters the supporting track is inside the longitudinal slot.

Also, in the preferred embodiment of the invention, the connecting component incorporates a safety lid designed to travel between a position in which it covers the selector switch, the pivoting means being then accessible, and in another position in which it covers the aforesaid means, the selector switch being then also accessible.

Further in the preferred embodiment of the invention, the connecting component incorporates built-in means to lock the adapter in its aforesaid extreme positions, thus maintaining the conductive terminals in contact with the corresponding conductors affixed inside the supporting track.

Other details and particularities of the present invention will come forth from the description that will follow, without limitation and with reference to the attached drawings.

Figure 1:
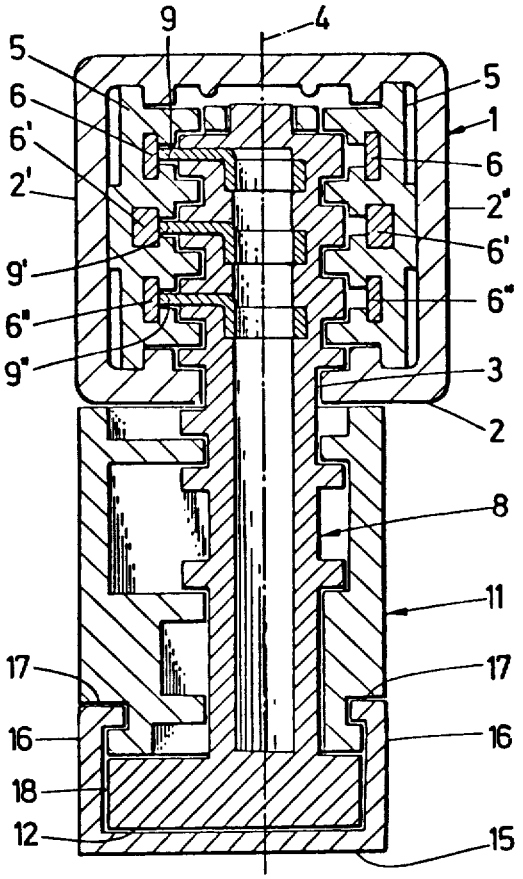
FIG. 1 represents a cross section view of an electrical connecting device, according to the invention, with a particular conception sketch of the supporting rack, the adapter being engaged in one of its extreme positions.
Figure 2:
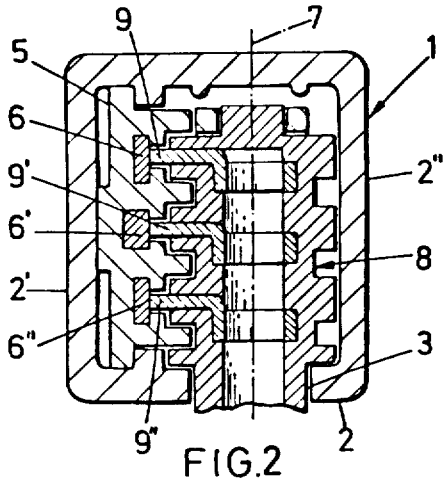
FIG. 2 represents a cross section view of a portion of the connecting component according to the invention, with another realization concept of the supporting track.
Figure 3:
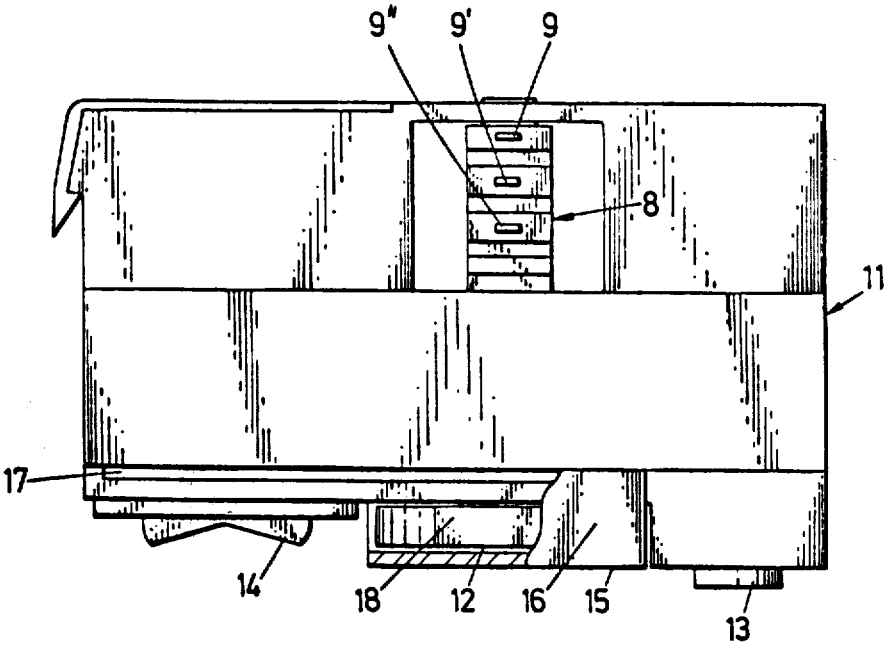
FIG. 3 represents a lateral evaluation view of a connecting component according to the invention and a partially cut out view of said part.

On the drawings the identical references relate to identical or analogous components.

BRIEF DESCRIPTION OF THE SPECIFIC EMBODIMENTS

In the supporting track 1, illustrated by the drawing 1, a lateral surface 2 of the track provides a longitudinal slot 3. In a cross section view, the supporting track profile 1 is symetric in relation of the symetric tracing plane 4, perpendicular to the face 2 of the track and passing by the median line of the opening 3. Inside of the track 1, conductors have been affixed for example by means of a sheath 5 made of insulating material, slid alongside of one of the lateral faces 2' and 2" of the track, adjacent of the face 2, or alongside of the two faces 2' and 2". On each one of these faces 2' and 2", three conductors 6,6' and 6" could be located one above the other, two of those conductors 6 and 6" being connected to an electrical power source not represented in the enclosed drawings, the conductor 6' located between the two mentioned conductors being the neutral.

Following another realization concept of the supporting track 1, illustrated by the drawing 2, the supporting track profile 1 cross section view is assymetric. With regard to the tracing plane 7 perpendicular to the track face 2 and passing by the median line of the opening 3, the side of the track having face 2' of track is exactly identical to the corresponding track part illustrated by drawing 1. On the other side of the plane 7, face 2 of the track is reduced to a little lip perpendicular to the face 2" of the trace. Face 2" is therefore situated to the proximity of the opening 3 and therefore this opening is off centered on face 2 of the track. The conception of this track is such that conductors can only be affixed alongside of the inside face 2 of the track.

According to the invention, the adapter 8 of the electrical connecting device is equipped at one of its extremities of three conductive terminals 9,9',9", the longitudinal axis of the adapter 8 and the longitudinal axis of these conductive terminals, in the shape of contact fingers, being situated in one plane in which the terminals are situated on the same side of the longitudinal axis of the adapter 8.

The adapter's body 8 is of a cylindrical shape. Its extremity, equipped with aforesaid conductive terminals protrudes out of the connecting component 11 and it is by this extremity that the connecting component is introduced inside the lengthwise slot 3 of the supporting track 1. When the connecting component is engaged inside the supporting track 1, a portion of this connecting component overhangs from the track. In this portion of the connecting component, means have been built in to let the adapter pivot. In the specific embodiment illustrated by the drawings, the pivoting means of the adapter are constituted by the extremity 12 of the adapter 8, opposed to its extremity equipped with conductive terminals and protruding out with regard to the extremity the connecting component overhangs out of the supporting track 1 when this component is inserted in the lengthwise slot of the track. With the help of the extremity 12 of the adapter 8, it is feasible to make the adapter pivot on its longitudinal axis to the left and right of the position it occupies at the time the connecting component 11 is inserted inside the supporting track 1, the connecting component being immobile in relation to the supporting track and during the pivoting of the adapter between its two extreme positions located on each side of the position it occupies when inserting the connecting component into the supporting track.

In at least one of the adapter 8 extreme positions, each conductive terminal 9,9',9" is in contact with one conductor affixed on one of the inside lateral faces of the track and adjacent to the face 2, the conductive terminals being oriented according to the longitudinal direction of the slot 3 and in the position in which the adapter finds itself when the connecting component 11 is introduced inside the supporting track 1.

In a connecting component according to the invention, and illustrated by drawing 1, conductors 6,6',6" are affixed on the two inside lateral faces 2',2' adjacent to the face 2 of the track, the conductive terminals 9,9',9" entering in each extreme position of the adapter 8, in contact with conductors 6,6',6" affixed on each of the faces 2' and 2".

Each conductive terminal 9,9',9" located inside the hollow cylindrical body of the adapter 8 is connected to conductor wire, the conductor wires have not been designed on the attached drawings, this hollow cylindrical body is made of an insulating material of preference in polycarbonate. The conductor wire coming from the terminal 9', which enters in contact with conductor 6' neutral is directly connected to one of the terminals of the receptacle 13, provided for on the connecting component 11 which overhangs out of the supporting track after being inserted in said track. The conductor wires coming from the conductive terminals 9 and 9", which enter in contact with conductors 6 and 6", they connected to a power source, are connected to other terminals of the receptacle 13 by means of a selector switch 14 having three positions ON-OFF-ON. This selector switch 14 which is located in the connecting component 11 which protrudes out of the supporting track and after its insertion in said track, allows to switch ON and OFF the power receptacle 13 in a selective manner, that is to select the circuit connected to conductive terminal 9, or circuit connected to terminal 9".

It is noteworthy to point out that the connecting component and the adapter which we have just described are not only usable with the track as per drawing 1 but can also be used with the track as per drawing 2.

Therefore, as it appears in drawing 3, the connecting component 11 has a safety lid 15 which slides on its lateral sides 16, themselves engaged and guided by grooves 17 located on the part of the connecting component that protrudes from the supporting track when said connecting component is introduced in the supporting track, between one position in which it covers the selector switch 14 and another position in which it covers also the extremity 12 of the adapter 8. The safety lid 15 can only be moved to cover the selector switch 14 when the selector switch is on OFF position.

The connecting component possesses also means to lock the adapter in its extreme positions. These means of locking are composed by at least a flat section 18 located in the extremity 12 of the adapter 8 and by lateral edges 16 of the safety lid 15, this flat section being located in such a way as to be parallel and place side by side to one of its edges in each of the extreme positions of the adapter.

It must be understood that the present invention is in no way limited to the above described concepts of realization and that many modifications could be brought without stepping out of the patent's framework.

It can also be assumed that the functions and disposition of the conductive terminals on the adapter's body and of the conductors disposition alongside the face or faces of the track adjacent to the one offering the longitudinal slot, could be changed or modified.

I claim:

1. For use in combination with an electrical power track of the type comprising a longitudinally extending housing having a longitudinal slot opening in one face thereof and containing within the housing at least one longitudinally extending continuous electrical conductor bar which is laterally spaced from the center of said slot opening, a selectively actuable electrical coupling device for a power consuming load comprising:

a connecting component body;

an insulative adapter member having a longitudinal axis and being disposed within and supported by said body for bidirectional rotation about said axis, said adapter member having a first end which extends substantially from and outside of the boundaries of said connecting component body and is of such dimension as to be insertable, in a first angular position taken about said axis, into an electrical power track through the slot therein, said adapter member carrying at said first end at least one radially projecting conductive terminal to engage a power bar in said track when the adapter body is rotated from the first angular position to a second angular position taken about said axis;

said adapter member including means for mechanically engaging said power track in the area of said slot only when rotated to said second position to maintain the adapter member in the inserted position;

the other end of said adapter member including means for rotating said adapter member about said axis relative to the connecting component body to electrically engage the terminal with the power bar;

outlet means on the connecting component body;

and selector switch means carried by said connecting component body adjacent but spaced from said other end of said adapter member for selectively electrically connecting the terminal with the output means when the adapter member is in said second angular position, the apparatus further including means for locking said adaptor member in the second annular position whenever said selector switch means electrically connects said terminal with the output means thus to ensure maintenance of the contact between the terminal and the electrical conductor bar.

2. Apparatus as defined in claim 1 wherein the locking means comprises a flat surface formed on said other end of said adapter member, and cover means slidably mounted on the connecting component body so as to slidably selectively cover said other end of the adapter member and having internal lateral surfaces, one of which is parallel and adjacent to the flat surface on the adapter member when the adapter member is in one of the angular positions whereby the safety cover locks the adapter body in position when covering said other end thereof.

3. Apparatus as defined in claim 1 wherein said adapter member comprises a plurality of axially spaced radially extending flanges and said connecting component body comprises a plurality of axially spaced radially inwardly projecting shoulders to provide axial containment for said adapter member within said connecting component body and to permit said angular rotation about said axis.

4. Apparatus as defined in claim 1 further comprising a safety lid slidably mounted on and supported by said connecting component body and displaceable relative thereto between the first position which covers said means for rotating said adapter member and a second position which covers said selector switch means.

5. Apparatus as defined in claim 4 wherein the adapter member is hollow along said axis to receive electrical conductors extending between said terminal and said selector switch means.

6. Apparatus as defined in claim 4 including at least two terminals mounted on the adapter member and spaced from one another along said axis of rotation.

7. Apparatus as defined in claim 4 wherein the safety lid is dimensioned so as to be slidable to the second position wherein it covers the selector switch means only when said selector switch means is in a predetermined position.

* * * * *